US007963131B2

(12) United States Patent
Zhang et al.

(10) Patent No.: US 7,963,131 B2
(45) Date of Patent: Jun. 21, 2011

(54) SECURITY CONTAINER WITH REARWARD FACING LOCK

(75) Inventors: Ningsheng Zhang, Charlotte, NC (US); Kevin Kinch, Sussex, WI (US); Brian V. Conti, Matthews, NC (US)

(73) Assignee: Checkpoint Systems, Inc., Philadelphia, PA (US)

( * ) Notice: Subject to any disclaimer, the term of this patent is extended or adjusted under 35 U.S.C. 154(b) by 24 days.

(21) Appl. No.: 12/241,691

(22) Filed: Sep. 30, 2008

(65) Prior Publication Data

US 2010/0077813 A1 Apr. 1, 2010

(51) Int. Cl.
*E05B 65/00* (2006.01)

(52) U.S. Cl. ..... 70/57; 70/57.1; 206/1.5

(58) Field of Classification Search ..... 70/57.1, 70/58, 63, 57; 206/1.5, 308.2
See application file for complete search history.

(56) References Cited

U.S. PATENT DOCUMENTS

| | | | | |
|---|---|---|---|---|
| 5,601,188 | A | 2/1997 | Dressen et al. | |
| 5,760,689 | A | 6/1998 | Holmgren | |
| 5,762,187 | A | 6/1998 | Belden, Jr. et al. | |
| 6,125,668 | A | 10/2000 | Belden, Jr. | |
| 6,422,387 | B1 | 7/2002 | Sedon et al. | |
| 6,676,175 | B2 | 1/2004 | Jaeb et al. | |
| 6,832,498 | B2 | 12/2004 | Belden, Jr. et al. | |
| 6,926,164 | B1 * | 8/2005 | Broadhead et al. | 70/57.1 |
| 7,100,402 | B2 | 9/2006 | Holmgren | |
| 7,183,918 | B1 | 2/2007 | Nichols, Sr. | |
| 7,194,879 | B2 | 3/2007 | Sedon et al. | |
| 7,262,699 | B2 | 8/2007 | Marsilio et al. | |
| 7,266,979 | B2 * | 9/2007 | Belden, Jr. | 70/57.1 |
| 7,394,369 | B2 * | 7/2008 | Horngren | 340/545.6 |
| 7,451,627 | B2 * | 11/2008 | Horngren et al. | 70/57.1 |
| 7,484,389 | B2 * | 2/2009 | Sedon et al. | 70/57 |
| 7,581,418 | B2 * | 9/2009 | Sedon et al. | 70/57.1 |
| 7,598,861 | B2 * | 10/2009 | Belden et al. | 340/545.6 |
| 7,610,782 | B2 * | 11/2009 | Lax et al. | 70/57.1 |
| 2005/0044904 | A1 * | 3/2005 | Horngren et al. | 70/57.1 |
| 2005/0172682 | A1 * | 8/2005 | Holmgren | 70/57.1 |
| 2006/0005587 | A1 * | 1/2006 | Necchi | 70/57.1 |
| 2006/0185989 | A1 | 8/2006 | Belden, Jr. et al. | |
| 2007/0209407 | A1 * | 9/2007 | Sedon et al. | 70/57.1 |

* cited by examiner

*Primary Examiner* — Suzanne D Barrett
*Assistant Examiner* — Christopher Boswell
(74) *Attorney, Agent, or Firm* — Sand & Sebolt

(57) ABSTRACT

A security container for retaining an item of merchandise therein; said security container comprising a base, a lid, a slider within the lid, a lid hole, a slider tab extending from the slider through the lid hole, and a locking mechanism unlocked through magnetic manipulation. The slider tab is located proximate the hinged side of the lid. As a user positions a key to magnetically unlock the locking mechanism, a protrusion on the key simultaneously pushes the slider tab which unlocks internal L-shaped lock tabs from hook tabs. The slider tab is located on the hinged side of the lid for aesthetic as well as safety purposes. By hiding the security features, potential customers focus on the product within the box. Likewise, a casual thief observing from the front and sides of the container is presented with no immediate means for entry. Thus, the invention provides a more secure container for displaying upscale merchandise.

23 Claims, 10 Drawing Sheets

SECURITY CONTAINER WITH REARWARD FACING LOCK

BACKGROUND OF THE INVENTION

1. Technical Field

This invention generally relates to security devices. More particularly, the invention relates to a lockable storage container for holding an item of merchandise for sale. Specifically, the invention relates to a storage container which has a magnetic locking mechanism that secures the item of merchandise within the container; and which has an internal alarm system that will trigger a remote alarm if the container is brought into the vicinity of a security gate without first being disarmed.

2. Background Information

Various retail establishments use numerous types of theft deterrent devices and systems to discourage shoplifting. One common theft deterrent system uses electronic article surveillance tags (EAS tags) attached to the items of merchandise. These EAS tags are configured to activate an alarm at a security gate that is positioned usually at the exit of the establishment if the merchandise containing the EAS tag passes through the secured gate before being removed to be deactivated at a checkout station.

Security storage containers are also known in the art. They are intended to securely lock merchandise in order to frustrate shoplifters. Known devices include six-sided boxes that receive items of merchandise, frames that surround portions of merchandise, and straps that pass through or around portions of merchandise. These devices are especially effective against impulse shoplifters. Although also somewhat effective against professional shoplifters, the professional shoplifter will eventually obtain a sample of the security storage container and determine a quick method for defeating the container. For instance, the shoplifter may develop a pick that opens the lock of the device. The shoplifter may also use a tool that breaks a portion of the device, rendering its security function useless. Once a shoplifter breaks a security device, the item of merchandise protected by the device may be separated from the device wherein the item of merchandise is no longer protected by the EAS tag. Therefore, there is need in the art for a secured container which substantially limits the possibility of defeating the internal security mechanism.

Security devices may securely lock higher end or "upscale" merchandise, including expensive perfumes and watches. The aesthetic qualities of the security devise often detract from the merchandise inside. The security devises common in the prior art are "clunky" or have notches, holes, or other generally unpleasing aesthetic qualities. The keyholes, latches, or locks are often located at the front of the container and detract from the merchandise.

Upscale retail establishments tend to forego the security and peace of mind of containing high end merchandise in typical security devises because it detracts from the prestige of the merchandise and store in general. Therefore, there is need in the art for a secured container which is aesthetically pleasing with minimal protrusions or other undesirable features readily visible to a customer.

BRIEF SUMMARY OF THE INVENTION

The invention provides a security storage container having a primary security feature that is adapted to be locked with pressure and unlocked with an appropriate key. The security storage container includes a secondary security feature that is activated when the security storage container passes through a secured gate, setting off an audible alarm.

The primary security feature requires a proprietary magnetic key. The key uses powerful and spaced magnets which actuate metal fingers within the security container. Magnets actuate the metal fingers, which release a sliding locking mechanism, allowing the lid to be opened. One of the main features of the invention is to provide a locking mechanism on the lid for the container. The lid is formed from a single mold having five exposed externally facing sides. The five external sides are nondescript and homogeneous, except for the rearward facing side having an opening for a sliding tab. A tab hole is formed in the rearward facing side adjacent a hinge and is the only entry point into the container when the lid is closed and the storage container is in the locked configuration.

A locking tab is formed with a first portion sized to slide into the tab hole, and a second portion sized to cover the area surrounding the tab hole. The tab is prevented from sliding when the lid is locked, and slides to release the lid when the magnetic key actuates the internal metal fingers. The tab hole and tab are located on the hinged side of the lid, opposite and spaced apart from the locking fingers and thus do not detract from the attractive appearance of the container.

A thief attempting to access the security container is forced to explore the rearward facing side of the lid, and may attempt to penetrate the container by accessing the sliding tab opening. However, the sliding tab does not provide a lock-picking entry point, and the would-be thief cannot release the lid by using conventional or subtle means, thus is more likely to attract the attention of store employees. The internal metal fingers prevent a thief from using brute force to move the sliding tab as the metal fingers only release through magnetic manipulation.

The invention portrays an impenetrable lid on a security container, with no visible means for entry. Attempts to remove the lid are severely frustrated by the nondescript nature of the lid, and rearward facing sliding lock. When the security container is secured at the base, a thief is further frustrated by having to reach around the container to meddle. The internal security mechanism requiring a magnetic key and the rearward facing sliding tab uniquely fortify this invention over the prior art.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
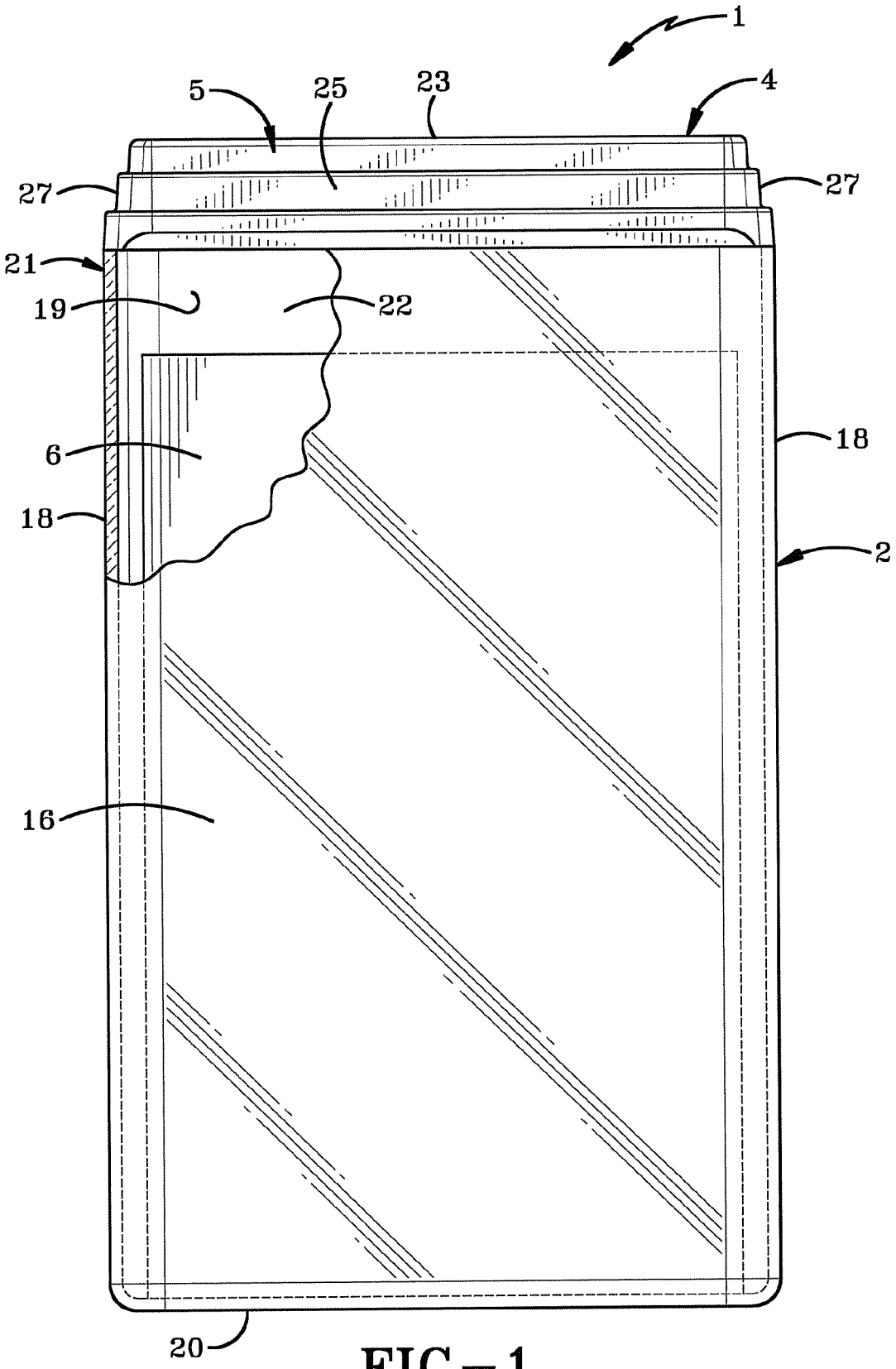
FIG. 1 is a front elevational view of the security storage container of the present invention, with portions broken away.

The security storage container of the present invention is generally indicated at 1 and is shown in FIGS. 1-16. Storage container 1 is in the form of a six-sided box having a base 2 and a lid 4 that is connected to base 2 and is movable between open and closed positions. Base 2 is sized to receive an item of merchandise 6 and lid 4 cooperates with base 2 to surround and secure the item of merchandise within base 2 when lid 4 is in the closed and locked position. Base 2 has a paralleliped configuration with a spaced front wall 16 and a back wall 22, and opposing left and right side walls 18 which extend upwardly and outwardly away from a bottom wall 20 and form an internal storage compartment 19 accessible through a top end 21. Lid 4 preferably is pivotally mounted to base 2 by a hinge 12. As will be hereinafter described, security storage container 1 also includes a locking mechanism, generally indicated at 15 (FIG. 9), for securing lid 4 in a locked position on base 2 preventing the unauthorized removal of merchandise 6 from within base 2.

Figure 2:
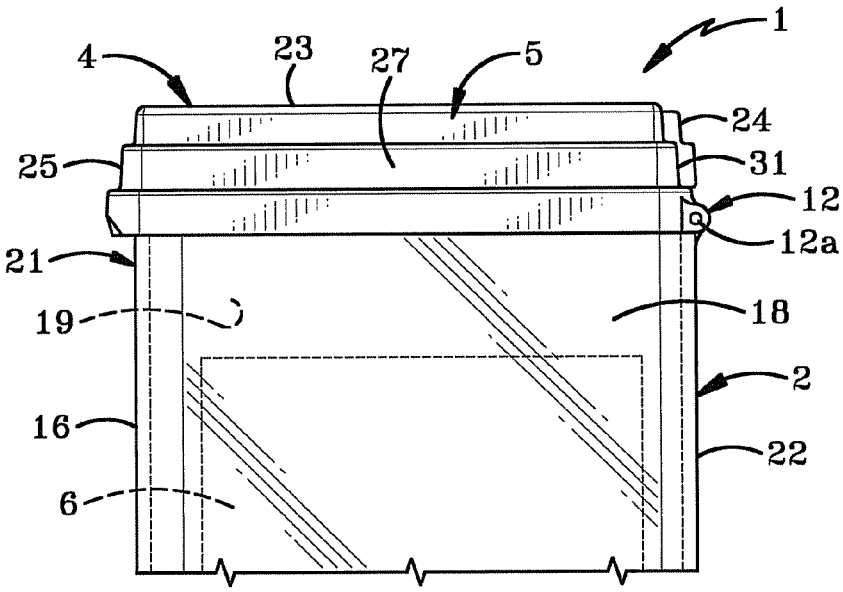
FIG. 2 is a partial right side view of the upper end of the storage container.
Figure 3:
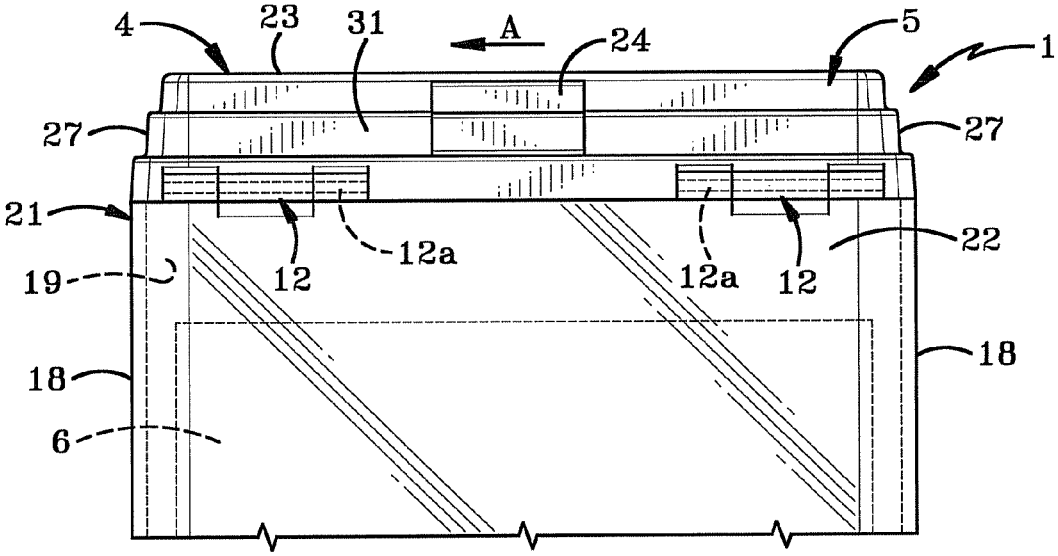
FIG. 3 is a partial back side view of the upper end of the storage container.
Figure 4:
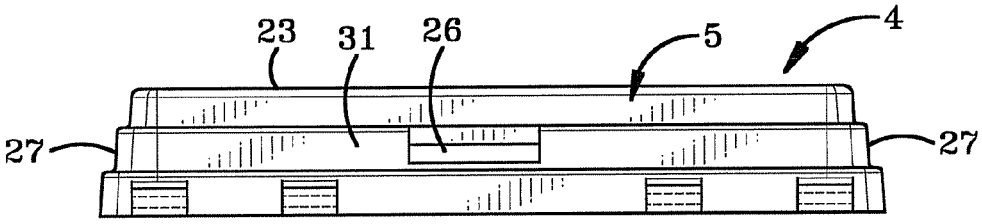
FIG. 4 is rear elevational view of the lid of the security storage container with the slider tab removed.
Figure 7:
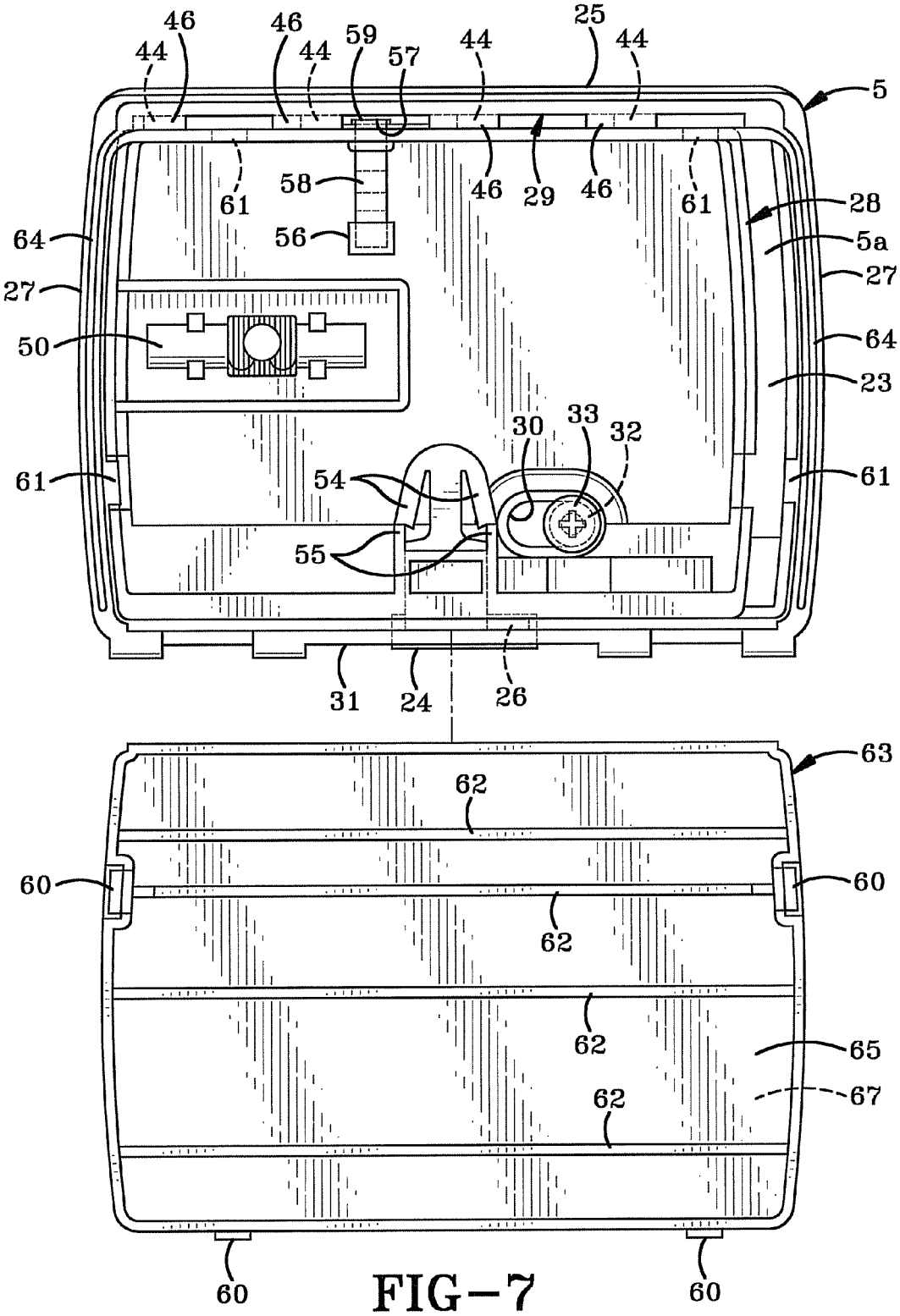
FIG. 7 is an exploded plan view of the lid closure plate of the security container.

Referring to FIG. 2 and 3, lid 4 is pivotally connected to base 2 by hinges 12 which are rotatable about hinge-pins 12*a*. Lid 4 closes top end 21 of base 2 when lid 4 is in the closed position and allows access to the internal storage compartment 19 of base 2 when lid 4 is in the open position. As shown in FIG. 7, lid 4 includes a top cap 5, a slider 28, a slider tab 24, and a bottom closure plate 63.

Figure 6:
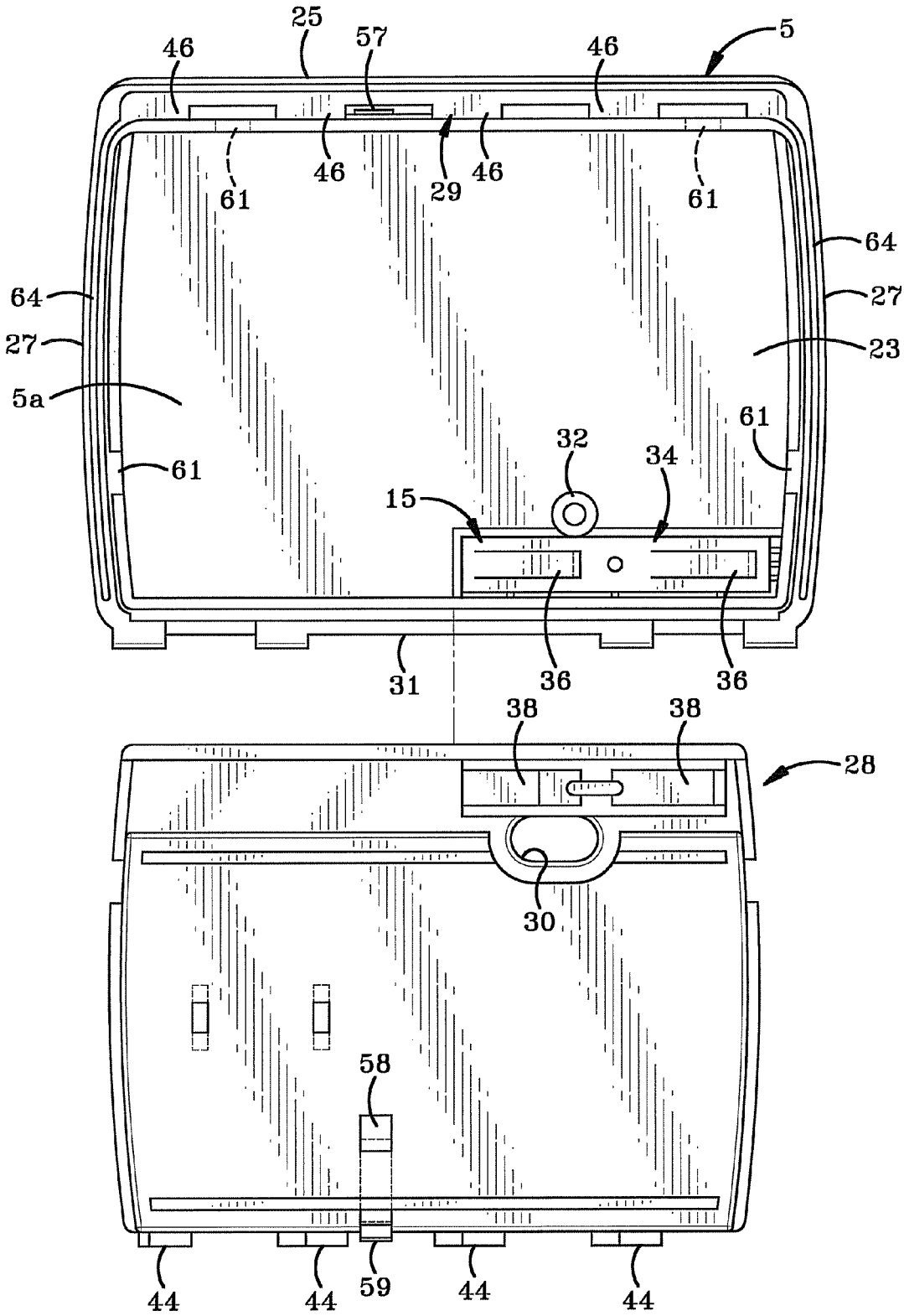
FIG. 6 is an exploded plan view of the lid and lid slider of the security container.
Figure 8:
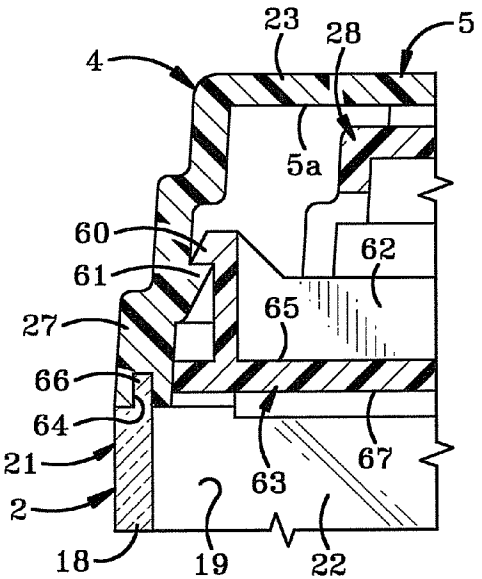
FIG. 8 is a front partial cross-sectional view of the of the lid sidewall.

Top cap 5 is indicated generally in FIG. 6. As shown in FIG. 8, each opposing side wall 18 of base 2 includes a lip 66 which is received in a channel 64 in top cap 5 when lid 4 is in the closed position. Top cap 5 has a flat top wall 23, homogeneous stepped front wall 25, side walls 27, and back wall 31. Top cap 5 is locked to base 2 by any suitable locking mechanism including mechanically-actuated devices. However, an example of a suitable locking mechanism is the mechanism shown and described in U.S. Pat. No. 7,194,879, published Mar. 27, 2007. The entire specification of U.S. Pat. No. 7,194,879 is incorporated herein by reference.

Figure 9:
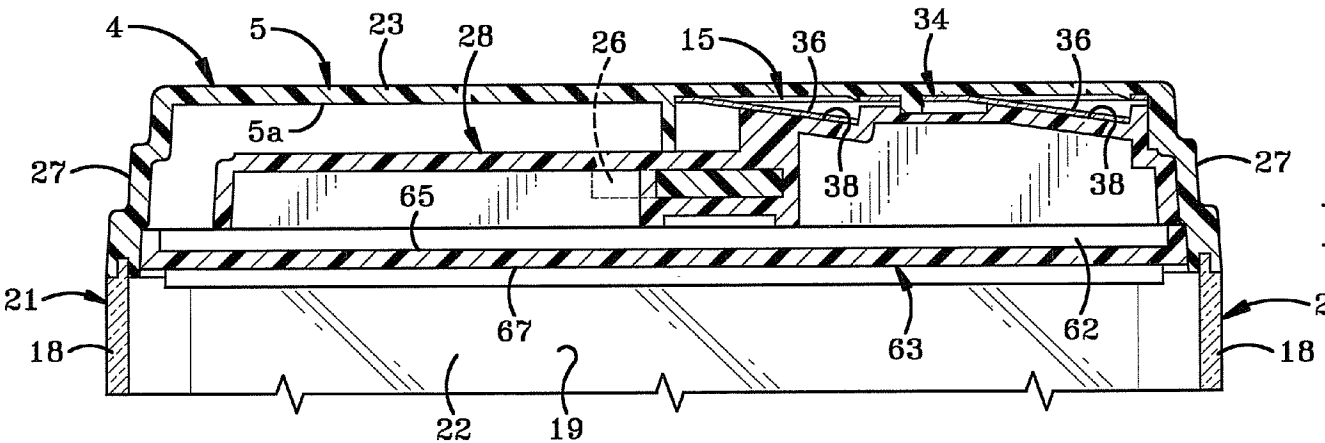
FIG. 9 is a fragmentary cross-sectional view of the lid and lid slider in the locked position.

In accordance with the invention, lid 4 is locked to base 2 by a slider, indicated generally at 28, which is slidably secured to an interior surface 5*a* of top cap 5, and by locking mechanism 15 (FIG. 9). Slider 28 is slidably secured to top cap 5 at the back by a fastener 33 (FIGS. 6 and 7) which is received through a slot 30 formed in slider 28 and into a boss 32 formed on interior surface 5*a* of top cap 5 and at the front by lock tabs 44, resting on the upper surfaces of tabs 46 on ledge 29. Inner end 24*a* of slider tab 24 is inserted through openings 26 and 35 of back wall 31 of top cap 5 and slider 28 respectively. Inner end 24*a* of slider tab 24 is formed with a pair of outwardly protruding arms 54. When fully inserted, outer ends of arms 54 engage inner ends of walls 55 formed on bottom side 28*a* of slider 28. This engagement allows the movement of slider 28 by way of slider tab 24. Slider 28 is selectively slidable relative to interior surface 5*a* of top cap 5 and is movable between locked and unlocked positions. Locking mechanism 15 includes a magnetically actuated metallic locking arm 34 that has two spring-biased movable fingers 36. Arm 34 and fingers 36 are designed to engage a portion of slider 28 that includes angled pockets 38. Pockets 38 are sized and shaped to receive fingers 36 therein and to prevent the withdrawal of the same therefrom unless fingers 36 are acted upon by magnets 70 of a magnetic key 68. Locking mechanism 15 holds slider 28 in the locked position when locking mechanism 15 is in the locked position, i.e., when fingers 36 are retained within pockets 38. Locking fingers 36 may be moved from the locked position (FIG. 9) to an unlocked position (FIG. 14) by using a key 68.

A retaining strip 58 (FIGS. 6 and 7) is secured to slider 28 by way of slot 53 and stay 56, and holds slider 28 in the unlocked position when locking mechanism 15 is in the unlocked position. When slider 28 is fully in the unlocked position, retaining strip 58 aligns with a notch 57 in interior surface 5*a* of top cap 5. Tension in retaining strip 58 pushes a locking end 59 into notch 57, whereby slider 28 is held in the open and unlocked position. The tension in retaining strip 58 is nominal. When outside pressure is applied to slider tab 24, retaining strip 58 releases from notch 57 and slider may move towards the locked position.

Referring to FIGS. 11-14, key 68 has magnets 70 disposed so as to align with fingers 36 on locking arm 34 when key 68 is correctly positioned on lid 4. Magnets 70 attract fingers 36 toward them and, once fingers 36 are realigned with locking arm 34, a protrusion 72 on key 68 pushes slider tab 24 which slides slider 28 back into the open position. It will be understood that locking mechanism 15 may be carried by either top cap 5 or slider 28 and may engage pockets 38 formed on the other of lid 4 and slider 28 depending on the particular design of locking mechanism 15.

Figure 10:
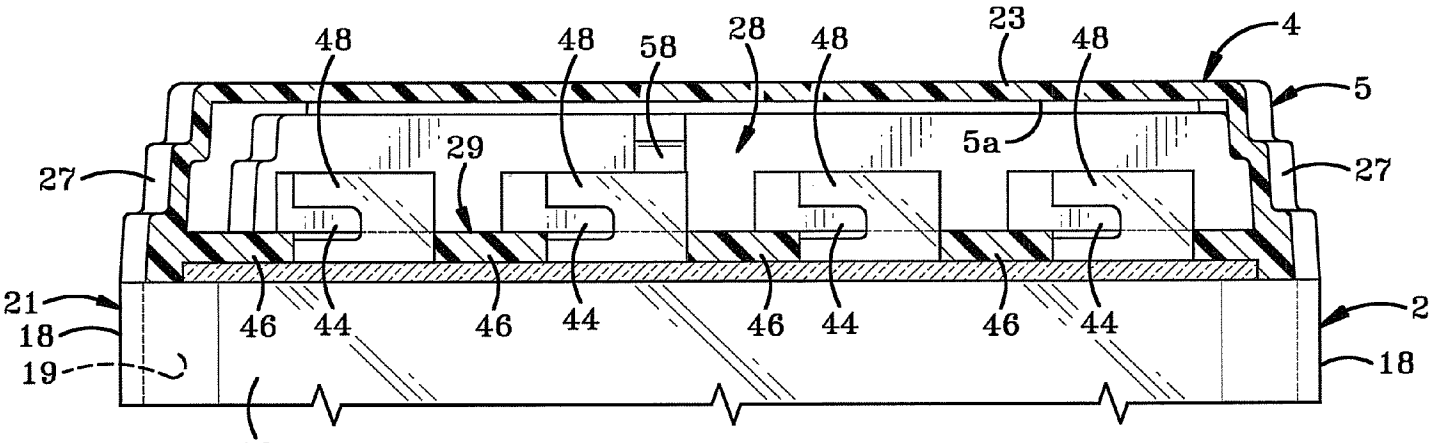
FIG. 10 is a front fragmentary cross-sectional view of the lid and base in the locked position.
Figure 15:
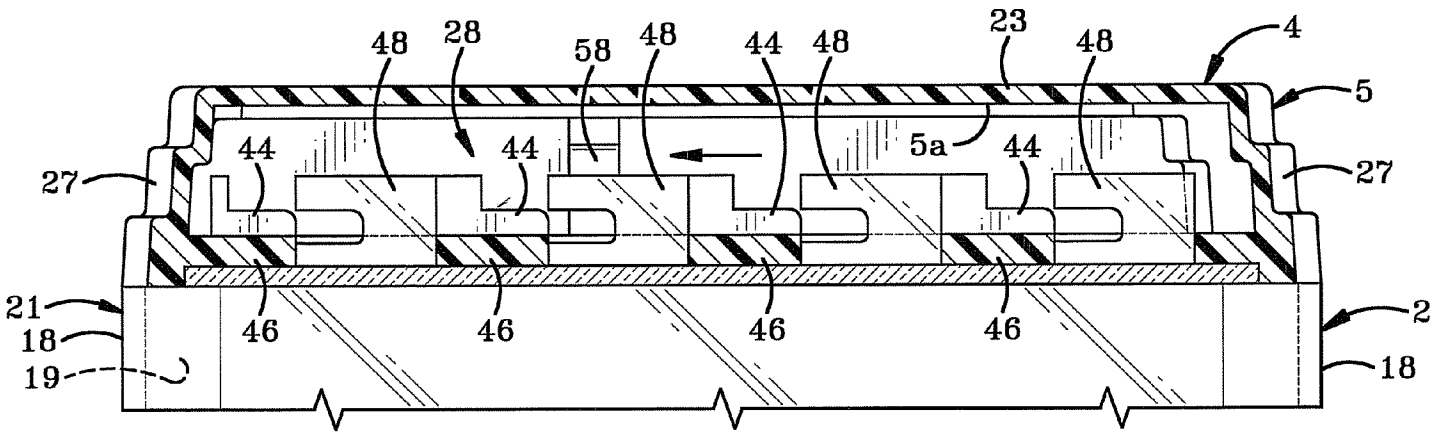
FIG. 15 is a front fragmentary cross-sectional view of the lid and base in the unlocked position.
Figure 11:
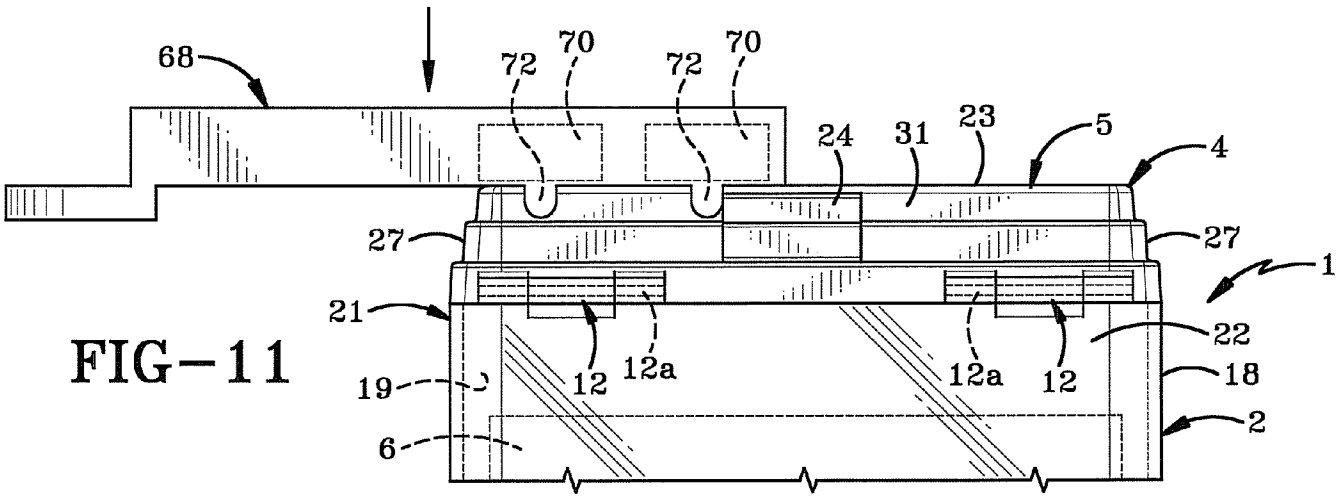
FIG. 11 is a rear fragmentary elevational view of the lid being engaged by a magnetic key to unlock the locking mechanism.
Figure 13:
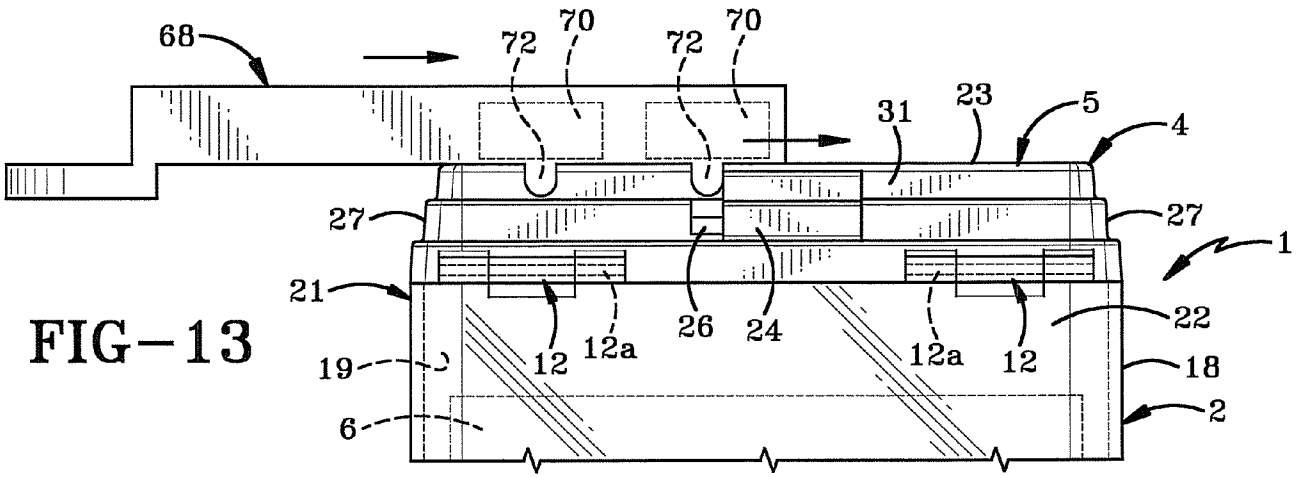
FIG. 13 is a fragmentary elevational view showing the magnetic key moving the slider tab to the unlocked position.
Figure 12:
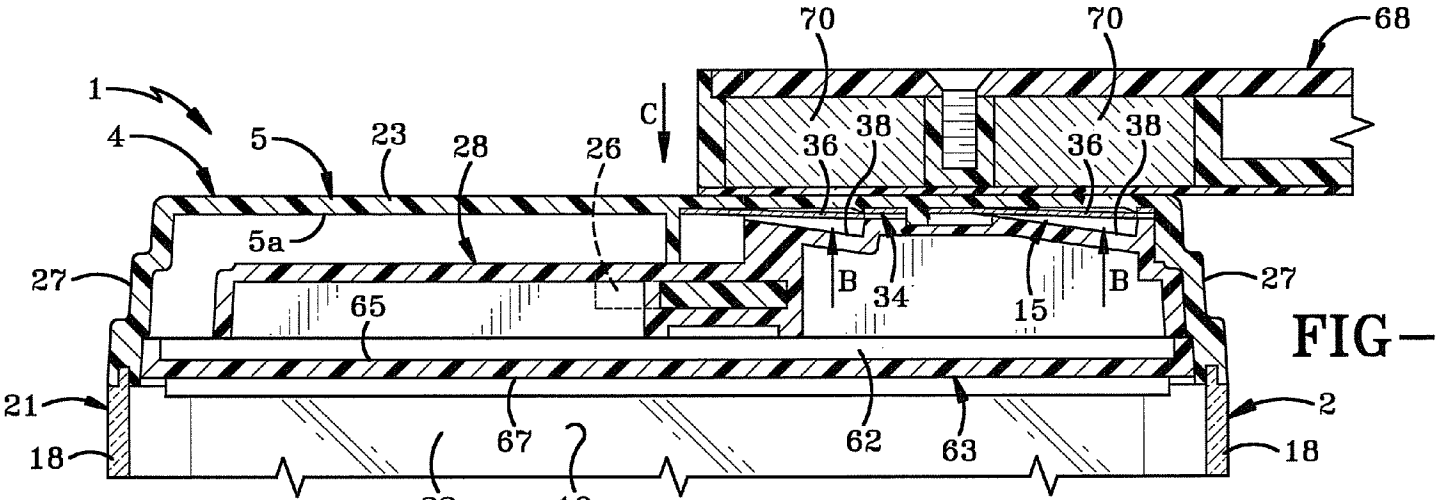
FIG. 12 is a fragmentary cross-sectional view of the lid and lid slider with the locking fingers in the unlocked position.
Figure 14:
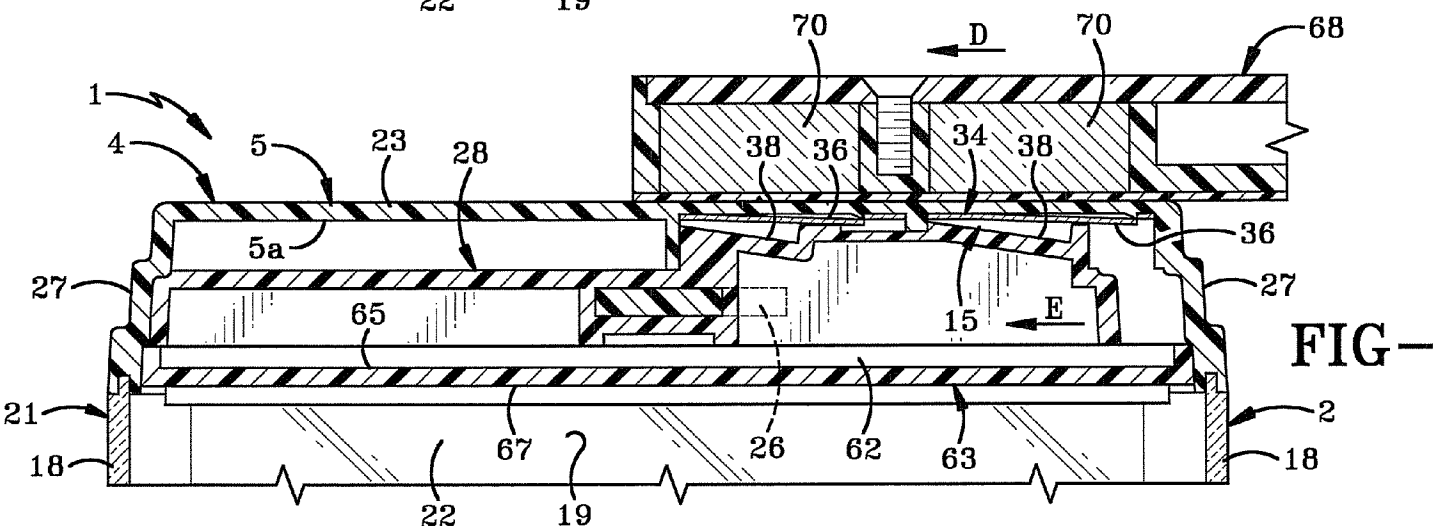
FIG. 14 is a partial cross-sectional view of the lid and lid slider in the unlocked position.

Slider 28 includes a plurality of spaced L-shaped lock tabs 44 which are shown in FIGS. 6, 10, and 15. Top cap 5 includes a plurality of spaced apart tabs 46 located on a ledge 29 extending inwardly from front wall 25, which may be seen in FIGS. 6 and 7. Furthermore, the front wall 16 of base 2 includes a plurality of space-apart hook tabs 48 which extend upwardly and outwardly therefrom, which may be seen in FIG. 5. Each hook tab 48 includes a U-shaped slot that lies substantially parallel to the upper edge of front wall 16. Tabs 48, 44, and 46 are typically integrally fabricated with base 2, slider 28 and top cap 5, respectively. When slider 28 is secured to top cap 5, the lower leg of each of the L-shaped lock tabs 44 abuts an upper surface of one of the tabs 46. Hook tabs 48 and lock tabs 44 engage each other and disengage from each other when slider 28 is slidably moved between the locked and unlocked positions. When slider 28 is moved to lock lid 4 and base 2 together, the lower leg of each lock tab 44 slides along the upper surface of the associated tab 46 and into the U-shaped slot of the adjacent hook tab 48. This interlocking of lock tabs 48 and 44 substantially prevents lid 4 from being pivoted from a closed position to an open position and container 1 is therefore locked. When slider 28 is moved in the opposite direction, the lower legs of lock tabs 44 slide out of the U-shaped slot of the associated hook tab 48. Lid 4 is then in an unlocked state where it may be pivoted between a closed and an open position to allow access to the internal storage compartment in base 2.

Figure 5:
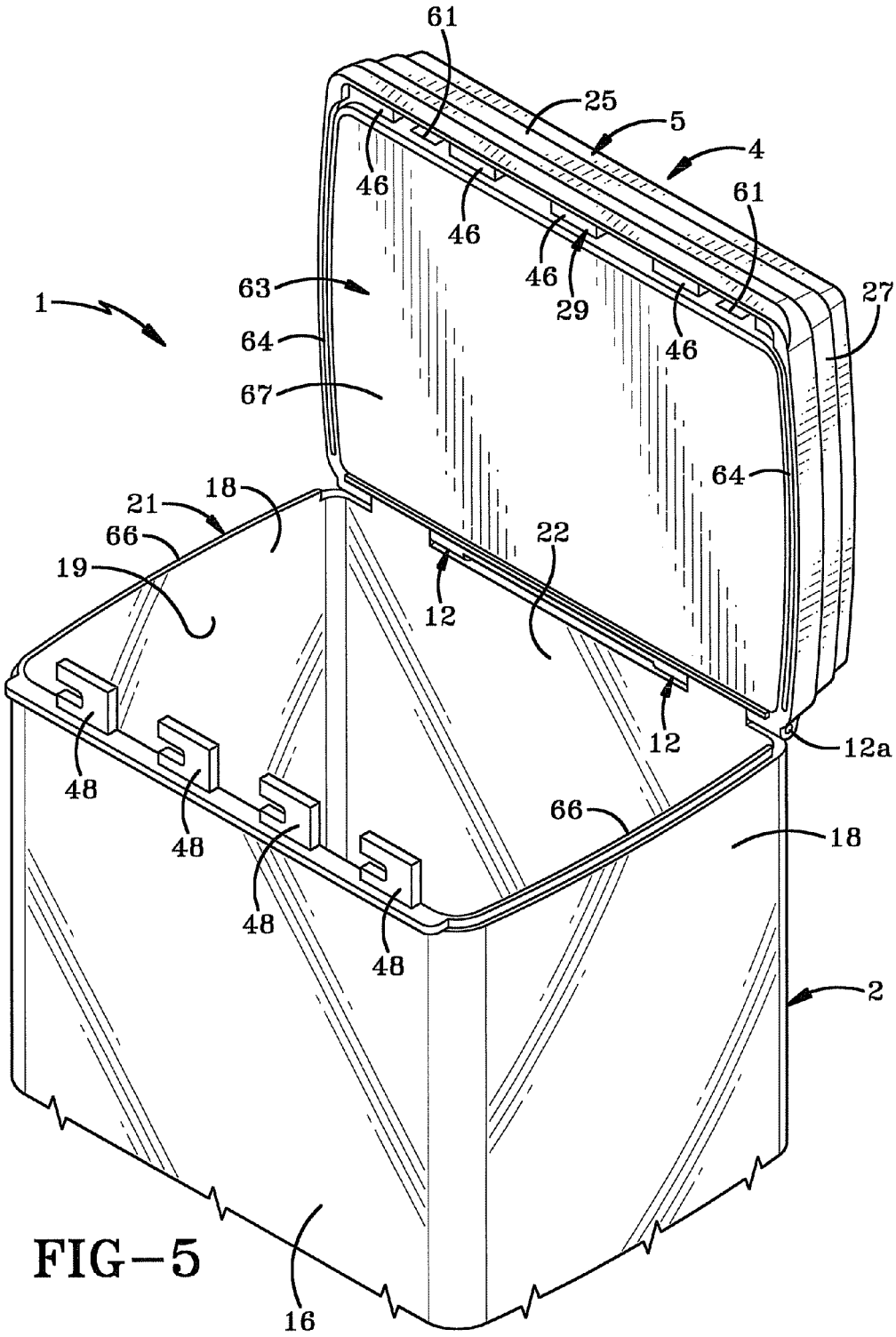
FIG. 5 is a fragmentary top perspective view of the security container with the lid in the unlocked and open position.

Shown in FIGS. 5 and 7, bottom closure plate 63 is secured to inner bottom edge of top cap 5, with slider 28 intermediate plate 63 and top cap 5. Plate 63 includes a flat, generally smooth surface on one outwardly facing side 67 with a rib 69 formed thereon adjacent the back edge, and a plurality of ribs 62 reinforcing an opposite, inwardly facing side 65. Plate 63 also includes a plurality of hook fasteners 60 extending outwardly away from inward side 65. Each fastener 60 locks with a corresponding shoulder 61 (FIG. 8) to secure plate 63 onto inner bottom edge of top cap 5. In this way, the internal workings of storage container 1 are hidden from view which is aesthetically pleasing as well as an added measure of security. When lid 4 is in the closed position (FIG. 9), rib 69 on side 67 of plate 63 extends below top edge 22*a* of back wall 22 of base 2 to block access into internal storage compartment 19.

Security storage container 1 is used in the following manner. Storage container 1 is adapted to receive items of merchandise 6 such as perfume or watches, or may be configured to hold other items of merchandise such as electronics, jewelry boxes, and the like. Base 2 is typically manufactured from a transparent, rigid, plastic material that allows the customer to view merchandise 6 held within storage container 1. When locking mechanism 15 is in the unlocked position (FIG. 14 and 15) and held by retaining strip 58, lid 4 may be opened to allow for the insertion of an item of merchandise into base 2. Lid 4 is then rotated to close the open end of base 2. The user then pushes finger slider tab 24 in the direction of arrow "A" (FIG. 3), causing locking end 59 of retaining strip 58 to let loose from notch 57 and allow slider 28 to move in the direction of the arrow "A". As previously described, this movement causes lock tabs 44 and hook tabs 48 to engage each other (FIG. 10). As shown in FIG. 9, movement of slider 28 also causes fingers 36 of lock arm 34 to slide into position over pockets 38. Fingers 36 are spring biased into alignment with the planar lock arm 34. Consequently, when fingers 36 are disposed over pockets 38, they spring out of alignment with arm 34 and become engaged in pockets 38, thereby further locking lid 4 and base 2 together.

Lid 4 includes top cap 5 with outwardly facing homogeneous sides and a flat top. Top cap 5 preferably is manufactured from an opaque material so that an observer cannot determine if an EAS tag or other alarm system is present within lid 4 and also cannot view the various components of the locking mechanism for securing storage container 1 in a closed and locked position. Top cap 5 on lid 4 is aesthetically pleasing, which allows it to be used in upscale retail establishments to display expensive merchandise. Located at the rear of container 1 as it faces away from potential customers, slider tab 24 offers the only entry point into locked container 1. The locking mechanism 15 is on the same side as the hinge but concealed from view. Container 1 may be secured at the base to a display case, table, etc., by any typical means, further reducing access to a potential thief.

Figure 16:
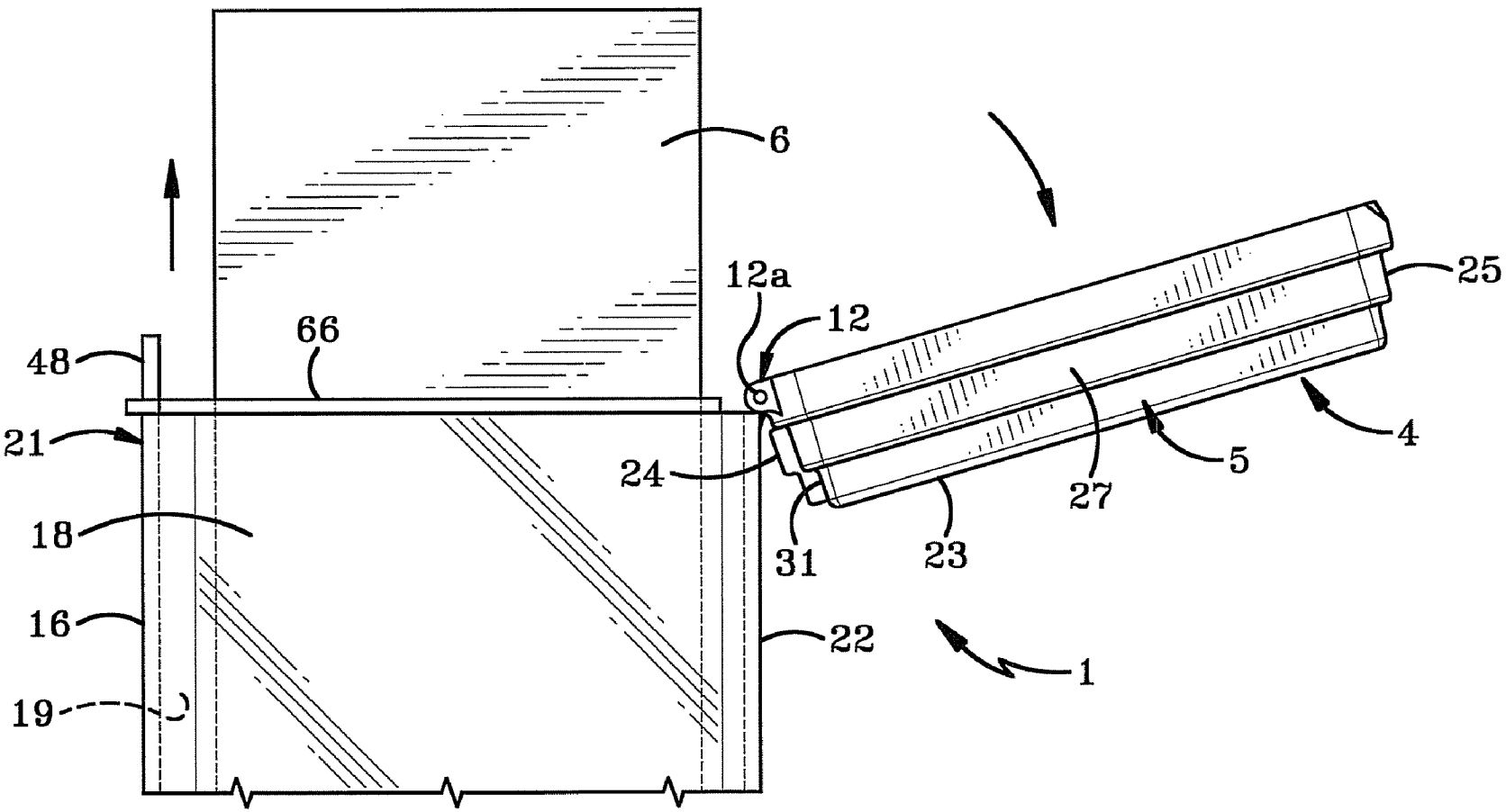
FIG. 16 is a fragmentary right side elevational view of the security container with the lid opened and an item of merchandise being removed therefrom.

If container 1 is brought within a certain preprogrammed range of a security gate at an entrance or exit of the protected environment, the EAS tag 50 will be triggered and thereby cause the security gates to sound a remote alarm. In order to prevent the alarm system from being triggered after the merchandise has been legally purchased by the customer, container 1 has to be disarmed by aligning key 68 with locking mechanism 15. Key 68 is correctly aligned on container 1 by placing it on top wall 23 of top cap 5 in the same direction of arrow "C" abutting protrusions 72 (FIG. 11) on key 68 onto edge 24*b* of slider tab 24 extending through back wall 31 of top cap 5. This brings magnets 70 (FIG. 12) on key 68 into proximity of fingers 36 on locking mechanism 15. Shown in FIG. 12, fingers 36 are attracted toward magnets 70 and move in the same direction as arrows "B", and are thereby withdrawn from pockets 38 and slider 28. Slider tab 24 is then moved by key 68 in the same direction as arrows "D" and "E" in FIG. 14, thereby moving slider 28 in the same direction as the arrow "E" relative to lid 4. The movement of slider 28 in the same direction as arrow "E" also causes lid 4 to be unlocked. Lid 4 can then be rotated into the open position, as shown in FIG. 16, and the item of merchandise may be removed from within base 2. As an improvement over the prior art, one single fluid motion by the user with key 68 unlocks fingers 36 as well as slider 28. Previous art required the user to hold or apply pressure to a tab or latch with one hand while sliding the key over the lid with the other hand.

It will be understood that any type of EAS tag or RFID tag can be used in storage container 1.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security container for retaining an item of merchandise therein; said security container comprising:

a base having a front, a back and an internal storage compartment adapted to receive the item of merchandise therein;

a lid having a top, a hinged side pivotally connected to the back of the base and a spaced apart locking side;

a hole formed in the hinged side of the lid;

a slider movably mounted within the lid, said slider being moveable between an unlocked and a locked position;

a slider tab extending from the slider through the lid hole; wherein the tab is below the top of the lid so that the tab is concealed from view in the locked and unlocked positions as viewed from the front of the base; and a locking mechanism contained within the lid for securing the slider in the locked position, said locking mechanism being unlocked by manipulation of internal elements allowing the slider to move from the locked to the unlocked position.

2. The security container as defined in claim 1 wherein the locking mechanism is positioned adjacent the hinged side and in which the locking side is opposite the hinge side.

3. The security container as defined in claim 2, wherein the base further includes a plurality of hook tabs extending outwardly from the base, and proximate the locking side of the lid.

4. The security container as defined in claim 3, wherein the slider further includes a plurality of L-shaped lock tabs, spaced to engage and disengage the hook tabs on the base when the slider is slidably moved between the locked and unlocked positions.

5. The security container as defined in claim 1, wherein the locking mechanism further includes a lock arm engageable with one of the slider and the lid, said lock arm including at least one spring-biased finger that is received within a pocket formed in one of the slider and the lid when the slider is moved into the locked position.

6. The security container as defined in claim 5, wherein the at least one finger of the lock arm is formed of a magnetically attractable material.

7. The security container as defined in claim 6, further comprising a key and wherein the key includes at least one magnet for withdrawing the finger from the pocket to unlock the locking mechanism.

8. The security container as defined in claim 7, further comprising a protrusion on the key, wherein said protrusion is spaced to align the magnet with the finger when the protrusion is adjacent the slider tab.

9. The security container as defined in claim 8, wherein the key actuates the slider tab while simultaneously withdrawing the finger from the pocket to unlock the locking mechanism.

10. The security container as defined in claim 1, further comprising an alarm system housed within the lid.

11. The security container as defined in claim 10, wherein the alarm system includes an EAS tag adapted to actuate a security gate alarm when detected by said security gate.

12. The security container as defined in claim 11, wherein the EAS tag is one of Radio Frequency (RF) sensitive or magnetically sensitive (AM).

13. The security container as defined in claim 1, wherein the slider further includes a retaining mechanism and wherein the retaining mechanism holds the slider in the unlocked position.

14. The security container as defined in claim 13, wherein the retaining mechanism further includes a retaining strip having a first and second end, said first end received in the slider and said second end spring-biased and engageable with a notch on the lid.

15. The security container as defined in claim 1, wherein the lid further includes two spaced apart sidewalls, each intermediate the hinged side and locking side of the lid.

16. The security container as defined in claim 15, wherein the base further includes two lips, spaced apart and extending outwardly from the base, each intermediate the hinged side of the lid and the hook tabs of the base.

17. The security container as defined in claim 16, wherein the lid further includes a channel recessed in each sidewall and spaced to receive each lip on the base when the lid is in the closed position.

18. The security container as defined in claim 1, wherein the slider tab is rigidly mated with the slider using a one-way snap fit.

19. The security container of claim 18 further comprising:

a portion of the slider tab which is inserted from outside the lid through the hole to form the snap fit with the slider.

20. The security container as defined in claim 1, wherein the lid further includes a bottom closure plate secured to an inner bottom edge of the lid, wherein the slider is slidable between the bottom closure plate and the lid relative to the bottom closure plate and the lid.

21. The security container of claim 20 wherein the bottom closure plate further comprises:

a plurality of hook openings formed in the inner bottom edge of the lid; and a plurality of hook fasteners extending outwardly away from the bottom closure plate, wherein the hook fasteners respectively snap into the hook openings to rigidly attach the bottom closure plate to the lid.

22. The security container as defined in claim 1, wherein the base is manufactured from a transparent plastic material and the lid is manufactured from an opaque plastic material.

23. The security container of claim 1 wherein the hinged side of the lid comprises:

an area surrounding the hole; and further comprising:

a first portion of the slider tab within the hole; and a second portion of the slider tab which is outside the lid and covers the area surrounding the hole.

* * * * *